US008675819B2

(12) United States Patent
Astle et al.

(10) Patent No.: US 8,675,819 B2
(45) Date of Patent: Mar. 18, 2014

(54) INTEGRAL LIQUID-COOLANT PASSAGEWAYS IN AN X-RAY TUBE

(75) Inventors: Travis Lee Astle, Salt Lake City, UT (US); David Craig Smith, Herriman, UT (US); Lawrence Wheatley Bawden, Kearns, UT (US); Jeffrey Steven Wassom, West Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 237 days.

(21) Appl. No.: 12/891,458

(22) Filed: Sep. 27, 2010

(65) Prior Publication Data

US 2012/0076278 A1 Mar. 29, 2012

(51) Int. Cl.
*H01J 35/10* (2006.01)

(52) U.S. Cl.
USPC ..... 378/141; 378/130

(58) Field of Classification Search
USPC ..... 378/130, 141, 199–200
See application file for complete search history.

(56) References Cited

U.S. PATENT DOCUMENTS

| | | | | |
|---|---|---|---|---|
| 4,995,065 | A | 2/1991 | Janouin et al. | |
| 5,802,140 | A | 9/1998 | Virshup et al. | |
| 6,553,096 | B1 | 4/2003 | Zhou et al. | |
| 2001/0024485 | A1 * | 9/2001 | Rogers | 378/140 |
| 2002/0085675 | A1 * | 7/2002 | Snyder et al. | 378/130 |
| 2006/0067478 | A1 * | 3/2006 | Canfield | 378/141 |
| 2009/0252298 | A1 * | 10/2009 | Luthardt et al. | 378/141 |

FOREIGN PATENT DOCUMENTS

| | | | |
|---|---|---|---|
| JP | 2001-273998 | A | 10/2001 |
| JP | 2003-197136 | A | 7/2003 |
| JP | 2004-511884 | A | 4/2004 |

OTHER PUBLICATIONS

International Search Report and Written Opinion dated Apr. 17, 2012 as received in application No. PCT/US2011/053497.

* cited by examiner

*Primary Examiner* — Hoon Song
(74) *Attorney, Agent, or Firm* — Maschoff Brennan

(57) ABSTRACT

Integral liquid-coolant passageways in an x-ray tube. In one example embodiment, an x-ray tube includes a can at least partially defining an evacuated enclosure, a cathode at least partially positioned within the evacuated enclosure, and an anode at least partially positioned within the evacuated enclosure. The can has first integral liquid-coolant passageways formed therein. The can is configured to have a liquid coolant circulated through the first integral liquid-coolant passageways to thereby cool the can without the can being submersed in a liquid coolant.

18 Claims, 12 Drawing Sheets

INTEGRAL LIQUID-COOLANT PASSAGEWAYS IN AN X-RAY TUBE

BACKGROUND

An x-ray tube directs x-rays at an intended target in order to produce an x-ray image. To produce x-rays, the x-ray tube receives large amounts of electrical energy. However, only a small fraction of the electrical energy transferred to the x-ray tube is converted within an evacuated enclosure of the x-ray tube into x-rays, while the majority of the electrical energy is converted to heat. If excessive heat is produced in the x-ray tube, the temperature may rise above critical values, and various portions of the x-ray tube may be subject to thermally-induced deforming stresses. Such thermally-induced deforming stresses may produce leaks in the evacuated enclosure of the x-ray tube and degrade other components of the x-ray tube, which thereby limits the operational life of the x-ray tube.

In order to reduce the likelihood of a vacuum leak and component degradation, the heat produced during x-ray tube operation is generally dissipated by submersing the x-ray tube in a liquid coolant contained in a coolant reservoir. The liquid coolant is generally circulated between a heat exchanger and the coolant reservoir in order to continually dissipate the heat generated within the x-ray tube.

The addition of a coolant reservoir and sufficient liquid coolant to submerse the x-ray tube adds cost, weight, and bulk to the x-ray tube. This additional weight and bulk can be detrimental in x-ray systems that require increasingly lighter weight and less bulky x-ray tube systems.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to integral liquid-coolant passageways in an x-ray tube. The example integral liquid-coolant passageways disclosed herein are integral to the housing that forms the vacuum enclosure and other portions of the housing of the x-ray tube. Liquid coolant can be circulated between these integral liquid-coolant passageways and an external heat exchanger in order to dissipate heat generated as a by-product of x-ray tube operation. This dissipation of heat by the circulating liquid coolant decreases thermally-induced deforming stresses in the x-ray tube evacuated enclosure and other x-ray tube components, thereby extending the operational life of the x-ray tube.

The example integral liquid-coolant passageways disclosed herein enable more efficient cooling of the x-ray tube without the x-ray tube being submersed in a liquid coolant, which enables higher power exposures, longer exposures, and/or more rapid exposures in the x-ray tube. Avoiding the need to submerse the x-ray tube in a liquid coolant avoids the added cost, weight, and bulk of a coolant reservoir filled with liquid coolant.

In one example embodiment, an x-ray tube includes a can at least partially defining an evacuated enclosure, a cathode at least partially positioned within the evacuated enclosure, and an anode at least partially positioned within the evacuated enclosure. The can has first integral liquid-coolant passageways formed therein. The can is configured to have a liquid coolant circulated through the first integral liquid-coolant passageways to thereby cool the can without the can being submersed in a liquid coolant.

In another example embodiment, an x-ray system includes a liquid coolant, a heat exchanger, and an x-ray tube. The x-ray tube includes a cathode at least partially positioned within an evacuated enclosure, a rotating anode at least partially positioned within the evacuated enclosure, a stator configured to rotate the anode, and a stator housing within which the stator is at least partially positioned. The stator housing has a first integral liquid-coolant passageway formed therein. The heat exchanger is configured to circulate the liquid coolant through the first integral liquid-coolant passageway to thereby cool the stator housing without the stator housing being submersed in a liquid coolant.

In yet another example embodiment, a process for forming an x-ray tube can includes various acts. First, a wax model of an x-ray tube can having integral liquid-coolant passageways is formed. Next, all internal and external surfaces of the wax model are coated with a silica slurry. Then, the coated wax model is heated to harden the silica coating into a shell and to remove the wax model leaving the shell hollow. Next, the hollow shell is filled with a molten metal. Then, the molten metal is cooled to solidify the metal. Finally, the shell is removed resulting in a metal x-ray tube can having integral liquid-coolant passageways.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to integral liquid-coolant passageways in an x-ray tube. Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. Example X-Ray Tube

Figure 1A:
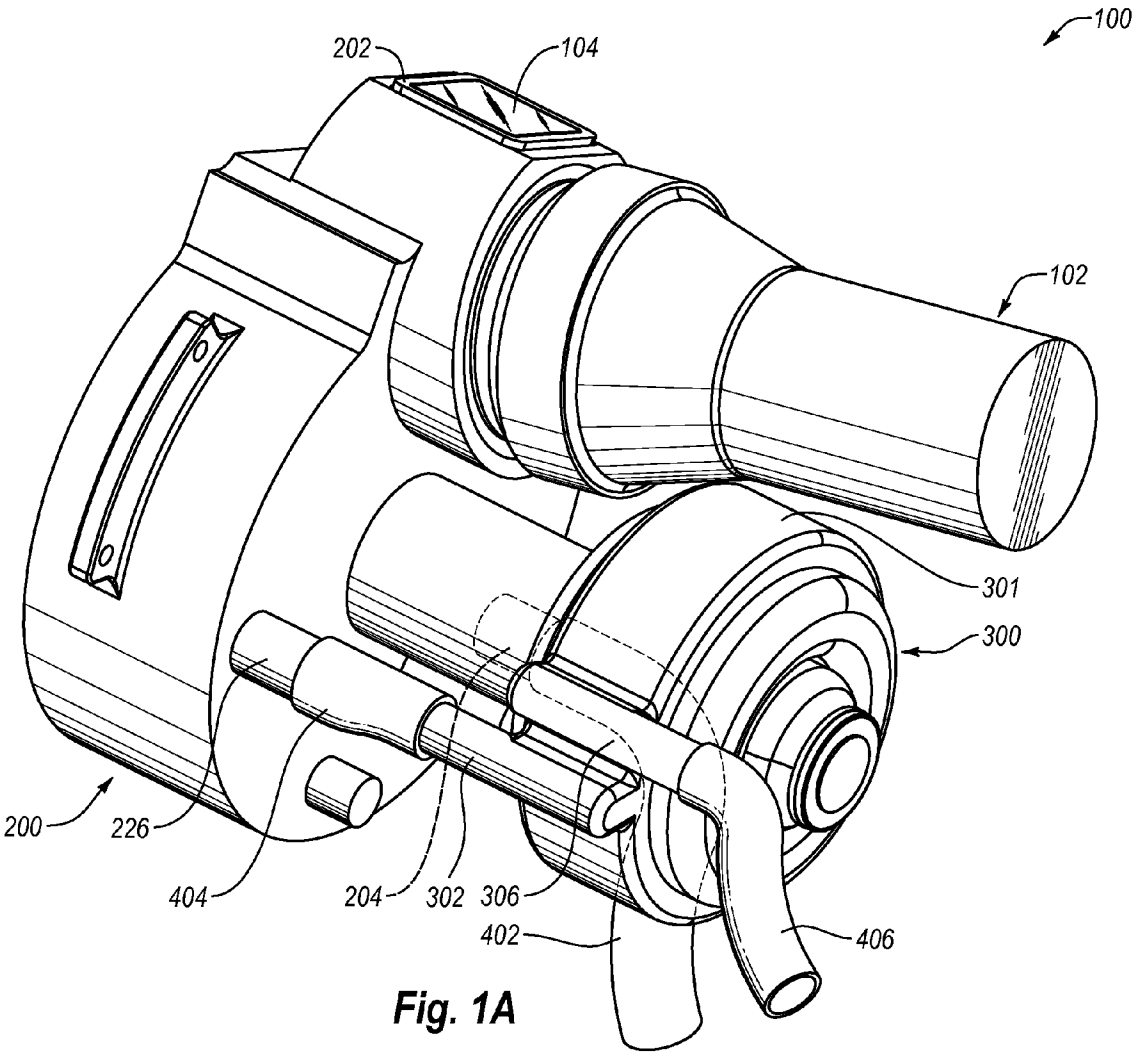
FIG. 1A is a perspective view of an example x-ray tube.
Figure 1B:
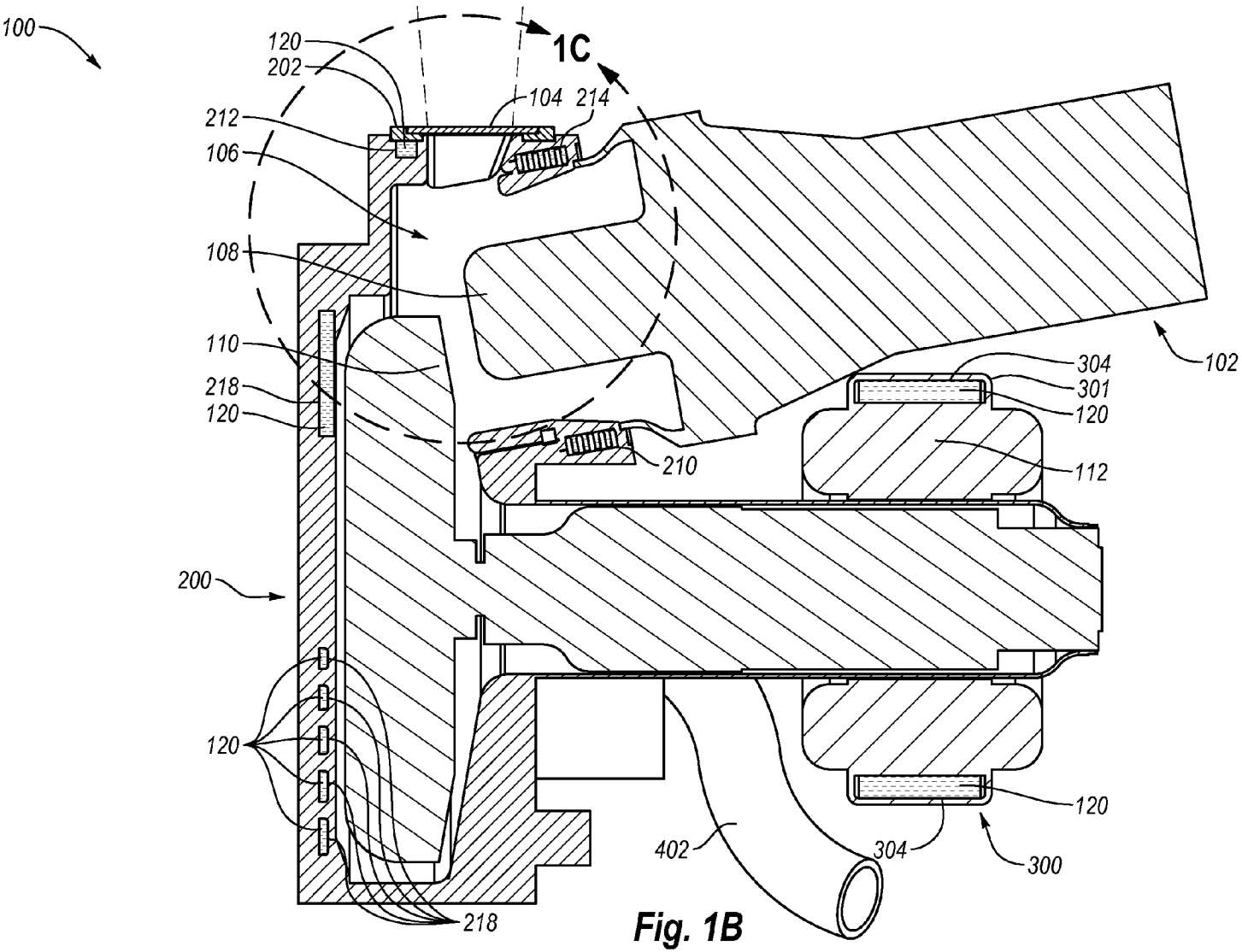
FIG. 1B is a side cross-sectional side view of the example x-ray tube of FIG. 1A.
Figure 1C:
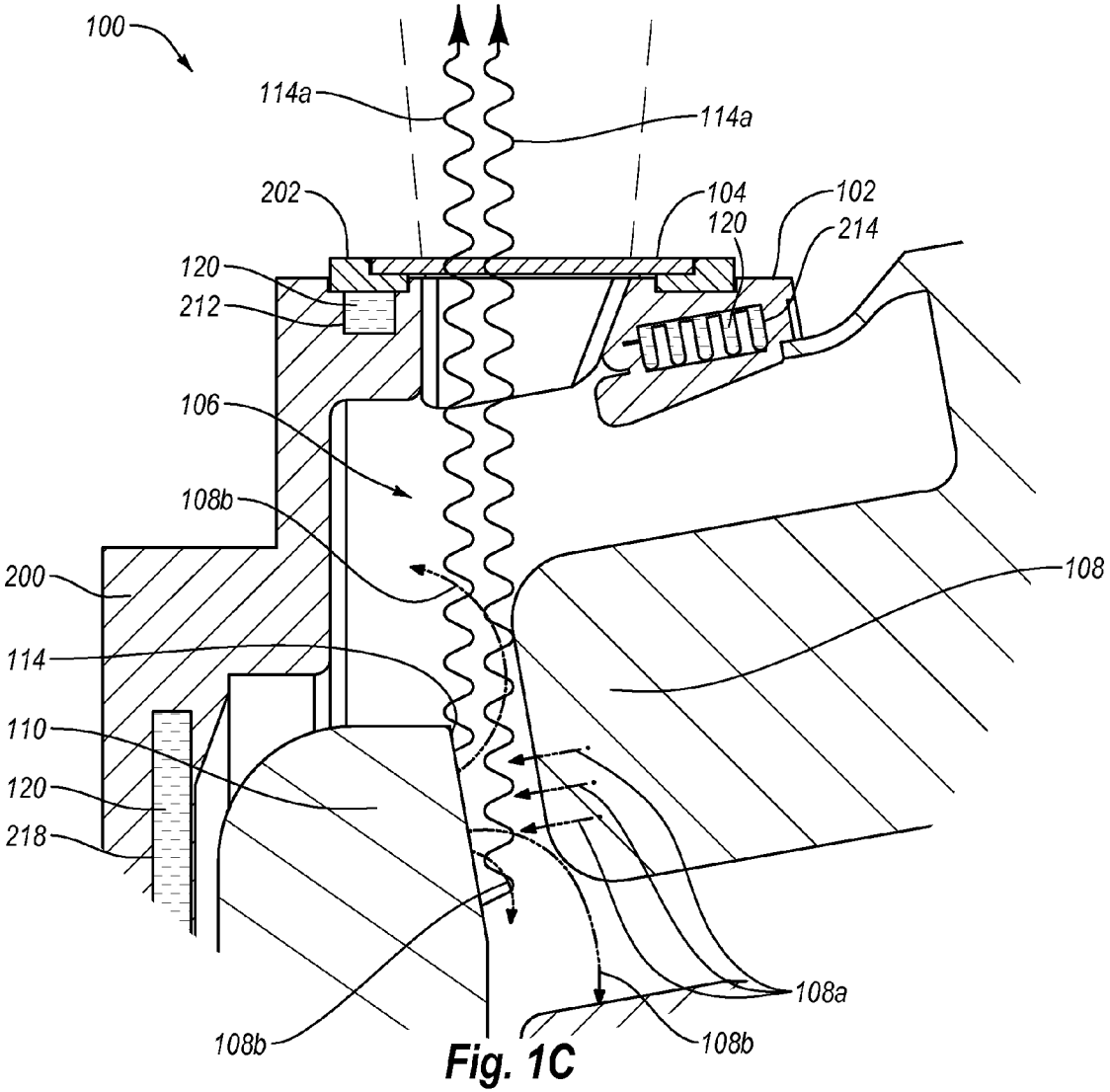
FIG. 1C is an enlarged cross-sectional side view of the example x-ray tube of FIG. 1B.

With reference first to FIGS. 1A-1C, an example x-ray tube 100 is disclosed. The example x-ray tube 100 is configured for use in mammography applications, but it is understood that the x-ray tube liquid coolant circulation system disclosed herein can be employed in x-ray tubes configured for use in other applications including, but not limited to, computed tomography (CT), diagnostic, or industrial.

As disclosed in FIG. 1A, the example x-ray tube 100 generally includes a can 200, a cathode assembly 102 attached to the can 200, a stator assembly 300 attached to the can 200, and an x-ray tube window 104 attached to a window frame 202 of the can 200. As disclosed in FIG. 1B, the stator assembly 300 includes a stator 112 that is positioned within a stator housing 301. The x-ray tube window 104 is comprised of an x-ray transmissive material, such as beryllium or other suitable material(s). The can 200 and the stator housing 301 may each be formed from copper, aluminum, stainless steel (such as 304 stainless steel), or other appropriate material. The can 200 and the stator housing 301, and their associated integral liquid-coolant passageways 206-224 and 304, as discussed below in connection with FIGS. 2A-3C, may be formed in a variety of ways including, but not limited to, casting, welding, brazing, machining, or some combination thereof.

As disclosed in FIG. 1B, the cathode assembly 102, the x-ray tube window 104, and the can 200 at least partially define an evacuated enclosure 106 within which a cathode 108 and a rotating anode 110 are positioned. More particularly, the cathode 108 extends from the cathode assembly 102 into the can 200 and the anode 110 is at least partially positioned within the can 200. The anode 110 is spaced apart from and oppositely disposed to the cathode 108, and may be at least partially composed of a thermally conductive material such as copper or a molybdenum alloy for example. The anode 110 and cathode 108 are connected in an electrical circuit that allows for the application of a high voltage potential between the anode 110 and the cathode 108. The cathode 108 includes a filament (not shown) that is connected to an appropriate power source (not shown). The anode 110 is rotated by the stator 112. It is noted that the anode 110 includes an anode shaft and a bearing assembly that enable the stator 112 to rotate the anode 110.

As disclosed in FIG. 1C, prior to operation of the example x-ray tube 100, the evacuated enclosure 106 is evacuated to create a vacuum. Then, during operation of the example x-ray tube 100, an electrical current is passed through the filament of the cathode 108 to cause electrons 108*a*, to be emitted from the cathode 108 by thermionic emission. The application of a high voltage differential between the anode 110 and the cathode 108 then causes the electrons 108*a* to accelerate from the cathode filament and toward a rotating focal track 114 that is positioned on the rotating anode 110. The focal track 114 may be composed for example of tungsten or other material(s) having a high atomic ("high Z") number. As the electrons 108*a* accelerate, they gain a substantial amount of kinetic energy, and upon striking the target material on the rotating focal track 114, some of this kinetic energy is converted into x-rays 114*a*.

The focal track 114 is oriented so that emitted x-rays 114*a* are directed toward the x-ray tube window 104. As the x-ray tube window 104 is comprised of an x-ray transmissive material, the x-rays 114*a* emitted from the focal track 114 pass through the x-ray tube window 104 in order to strike an intended target (not shown) to produce an x-ray image (not shown). The window 104 therefore seals the vacuum of the evacuated enclosure of the x-ray tube 100 from the atmospheric air pressure outside the x-ray tube 100 and yet enables the x-rays 114*a* generated by the rotating anode 110 to exit the x-ray tube 100.

The orientation of the focal track 114 also results in some of the electrons 108*a* being deflected off of the focal track 114 toward various interior surfaces of the can 200, the cathode assembly 102, and the window 104. These deflected electrons are referred to as "backscatter electrons" 108*b* herein. The backscatter electrons 108*b* have a substantial amount of kinetic energy. When the backscatter electrons 108*b* strike the integral surfaces of the can 200, cathode assembly 102, and the window 104, a significant amount of the kinetic energy of the backscatter electrons 108*b* is transferred to the can 200, cathode assembly 102, and the window 104 as heat. In addition, the stator 112 also generates heat during operation, which is transferred to the anode 110, the can 200, and the stator housing 301 (see FIG. 1B).

Although the example x-ray tube 100 is depicted as a rotating anode x-ray tube, example embodiments disclosed herein may be employed in other types of x-ray tubes. Thus, the example x-ray tube liquid coolant circulation system disclosed herein may alternatively be employed, for example, in a stationary anode x-ray tube.

2. Example X-Ray Tube Liquid Coolant Circulation System

With continued reference to FIGS. 1A and 1B, aspects of an example x-ray tube liquid coolant circulation system are disclosed. The example x-ray tube liquid coolant circulation system generally functions to dissipate heat in the x-ray tube 100, including heat in the can 200, cathode assembly 102, window 104, and stator assembly 300 by circulating a liquid coolant 120. In one example embodiment, the coolant 120 may be a dielectric liquid coolant. Examples of dielectric liquid coolants include, but are not limited to: fluorocarbon or silicon based oils, SYLTHERM, or de-ionized water. The example x-ray tube liquid coolant circulation system also includes a heat exchanger (not shown) that functions to circulate the coolant 120 between the heat exchanger and the example x-ray tube 100.

A first example mode of operation of the example x-ray tube liquid-coolant circulation system will now be disclosed. First, cooled coolant 120 flows into the can 200 through a hose 402 that is coupled to a port 204 defined in the can 200. The coolant 120 then flows through various integral liquid-coolant passageways 206-224 of the can 200, as discussed below in connection with FIGS. 2A-2C. The coolant 120 then exits the can 200 at another port 226 defined in the can 200. The coolant 120 then flows through a hose 404 that couples the port 226 to a port 302 defined in the stator housing 301. The coolant 120 then flows through an integral liquid-coolant passageway 304 of the stator housing 301, as discussed below in connection with FIGS. 3A-3C. Then, at another port 306 defined in the stator housing 301, the coolant 120 flows out of the stator housing 301 through a hose 406 that is attached to the port 306.

As the coolant 120 is actively circulated through the integral liquid-coolant passageways of the x-ray tube 100, the temperature of the coolant 120 is raised as heat generated by the x-ray tube 100 is transferred to the coolant 120. In at least some example embodiments, the heated coolant 120 exiting the x-ray tube 100 is circulated through and cooled by an external heat exchanger (not shown) before being circulated back into the x-ray tube 100 through the hose 402.

The first example mode of operation described above is only one example of an operation mode for the example x-ray tube liquid-coolant circulation system. In a second example mode of operation, the coolant 120 is circulated in the opposite direction from that described above. In a third example mode of operation, the coolant 120 is circulated into the can 200 through the port 226, out of the can 200 through the port 204, and then through the stator housing 301 by rerouting the hoses 402-406.

As the coolant 120 circulates through the can 200 and the stator assembly 300, the coolant 120 functions to transfer the heat in the can 200 and the stator assembly 300 to the coolant 120. The heat that is transferred to the coolant 120 is then dissipated as the coolant 120 is circulated through an external heat exchanger (not shown). This dissipation of heat by the circulating the coolant 120 decreases thermally-induced deforming stresses in the x-ray tube evacuated enclosure 106 and other x-ray tube components, thereby extending the operational life of the x-ray tube 100.

The example integral liquid-coolant passageways 206-224 and 304 enable more efficient cooling of the x-ray tube 100 without the x-ray tube 100 being submersed in a liquid coolant, which enables higher power exposures, longer exposures, and/or more rapid exposures in the x-ray tube 100. Avoiding the need to submerse the x-ray tube 100 in a liquid coolant avoids the added cost, weight, and bulk of a coolant reservoir filled with liquid coolant. Increasingly, relatively heavy image intensifiers are being replaced with relatively light flat panel detectors. The decreased weight of the reservoir-less x-tray tube 100 enables a balanced load in an x-ray system with the relatively light x-ray tube 100 on one side of the system and the relatively light flat panel detector on the other side of the system.

Further, the use of integral liquid-coolant passageways allow for more efficient and strategically placed cooling of the x-ray tube 100. For example, areas of the x-ray tube 100 that are subject to a higher heat flux can be cooled more aggressively using integral liquid-coolant passageways than using a more passive submersion of the x-ray tube 100 in a liquid-coolant reservoir.

3. Example Can

Figure 2B:
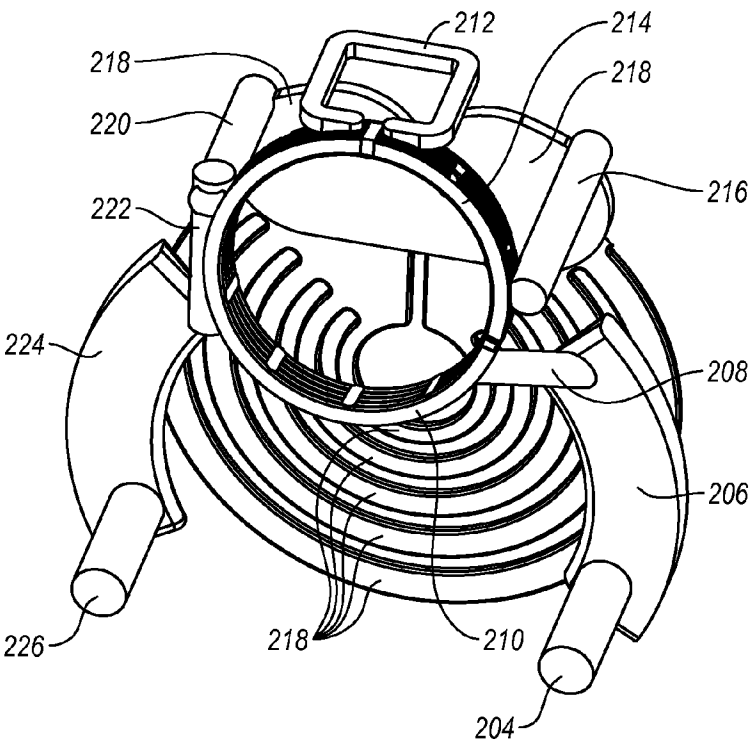
FIG. 2B is a schematic view of an outline of integral liquid-coolant passageways of the example can of FIG. 2A.
Figure 2A:
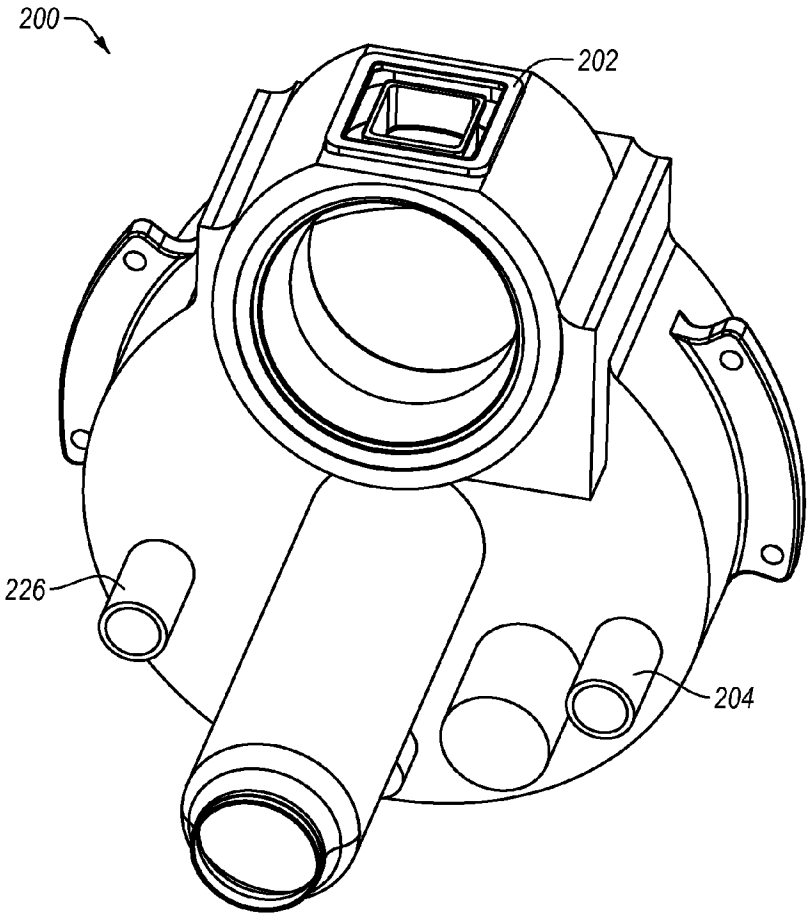
FIG. 2A is a perspective view of an example can of the example x-ray tube of FIG. 1A.
Figure 2C:
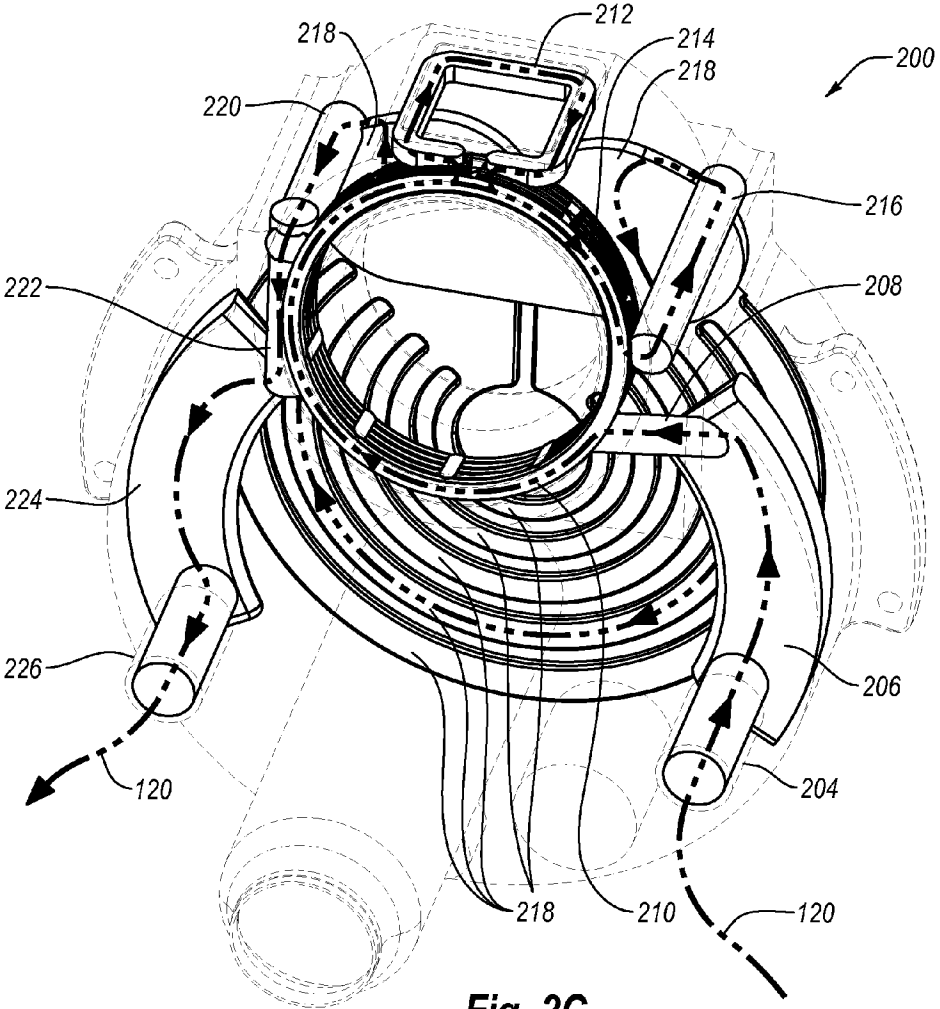
FIG. 2C is a partially transparent view of the example can of FIG. 2A showing the positions of the integral liquid-coolant passageways of FIG. 2B.

With reference to FIGS. 2A-2C, additional aspects of the example can 200 are disclosed. As disclosed in FIG. 2A, the can 200 defines the window frame 202 to which the x-ray tube window 104 (see FIGS. 1A and 1B) is configured to be attached and through which x-rays 114*a* produced at the focal track 114 of the anode 110 may exit the can 200 (see FIG. 1C). The can 200 also defines ports 204 and 226.

As disclosed in FIGS. 2B and 2C, and with reference again to FIGS. 1B and 1C, the can 200 also defines integral liquid-coolant passageways 206-224. An outline of the liquid-coolant passageways 206-224 is disclosed in FIG. 2B, while FIG. 2C discloses the positions of the integral liquid-coolant passageways 206-224 within the can 200.

The passageway 206 is generally positioned facing the focal track 114 of the anode 110 and connects the port 204 to the passageway 208. The passageway 208 connects to the passageways 210. The passageways 210 generally surround a portion of the cathode 108 and connect to the passageway 212. The passageway 212 generally surrounds the window frame 202 and connects to the passageways 214. The passageways 214 generally surround another portion of the cathode 108 and connect to the passageway 216. The passageway 216 is generally positioned alongside the cathode 108 and the anode 110 and connects to the passageways 218. The passageways 218 are generally positioned behind the anode 110 and connect to the passageway 220. The passageway 220 is generally positioned alongside the cathode 108 and the anode 110, opposite the passageway 216, and connects to the passageway 222. The passageway 222 connects to the passageway 224. The passageway 224 is generally positioned facing the focal track 114 of the anode 110 and connects to the port 226.

As disclosed in FIG. 2C, as the coolant 120 circulates into the can 200 through the port 204, for example, the coolant 120 circulates in turn through each of the passageways 206-224 before exiting the aperture body through the port 226. As the coolant 120 flows through the integral liquid-coolant passageways 206-224, the circulating coolant 120 functions to transfer the heat in the can 200 caused by the impingement of the backscatter electrons 108*b* (see FIG. 1C) to the circulating coolant 120.

4. Example Stator Housing

Figure 3B:
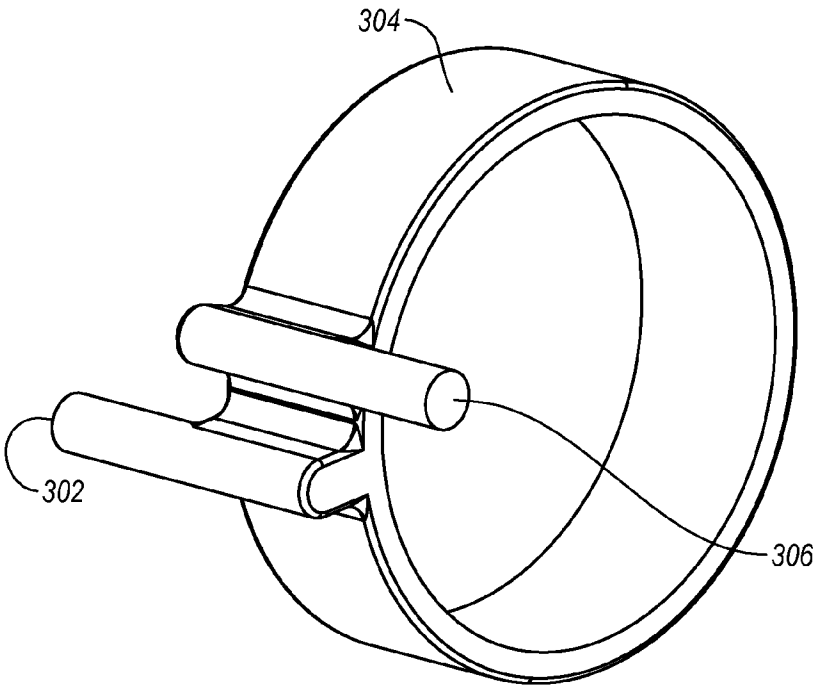
FIG. 3B is a schematic view of an outline of an integral liquid-coolant passageway of the example stator housing of FIG. 3A.
Figure 3A:
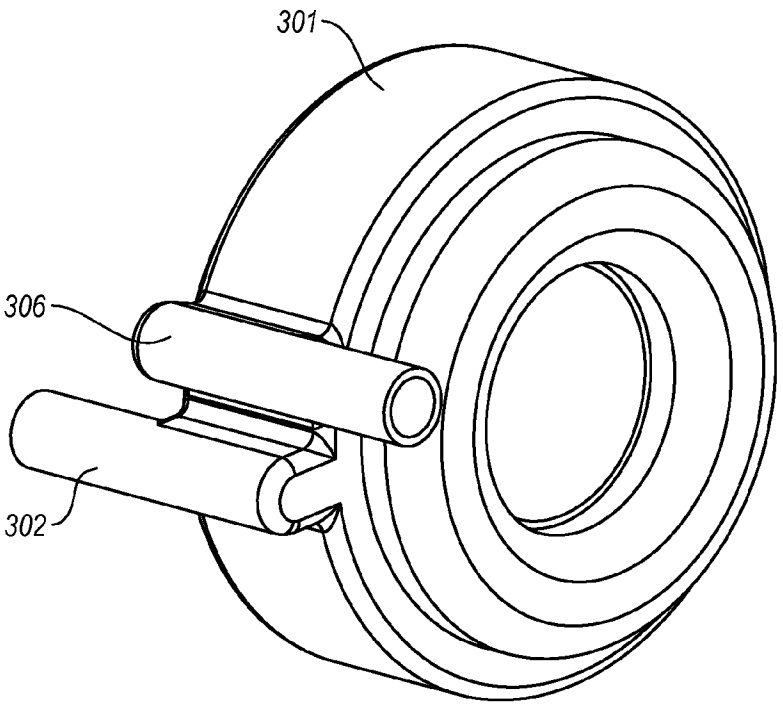
FIG. 3A is a perspective view of a stator housing of the example x-ray tube of FIG. 1A.
Figure 3C:
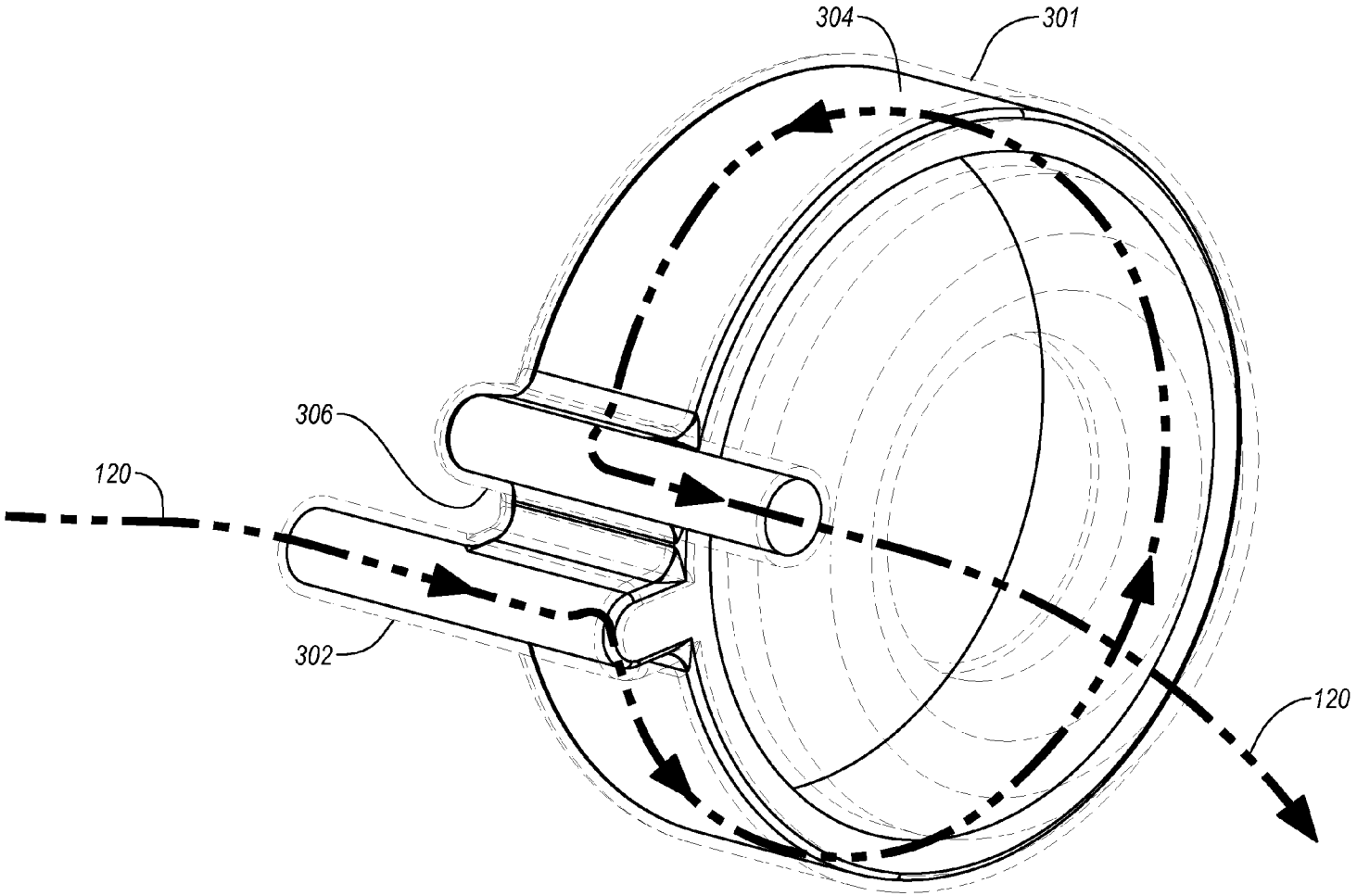
FIG. 3C is a partially transparent view of the example stator housing of FIG. 3A showing the position of the integral liquid-coolant passageway of FIG. 3B.

With reference to FIGS. 3A-3C, additional aspects of the stator housing 301 are disclosed. As disclosed in FIG. 3A, the stator housing 301 defines ports 302 and 306. As disclosed in FIGS. 3B and 3C, the stator housing 301 also defines an integral liquid-coolant passageway 304. An outline of the liquid-coolant passageway 304 is disclosed in FIG. 3B, while FIG. 3C discloses the position of the integral liquid-coolant passageway 304 within the stator housing 301. The passageway 304 substantially surrounds the stator 112 (see FIG. 1B) and connects the port 302 to the port 306.

As disclosed in FIG. 3C, as the coolant 120 circulates into the stator housing 301 through the port 302, for example, the coolant 120 circulates through the passageway 304 before exiting the housing of the stator housing 301 through the port 306. As the coolant 120 flows through the integral liquid-coolant passageway 304, the circulating coolant 120 functions to transfer the heat in the stator housing 301 caused by the operation of the stator 112 (see FIG. 1B) to the circulating coolant 120.

Although the integral liquid-coolant passageways of the x-ray tube 100 disclosed herein are generally formed in the can 200 or the stator housing 301, it is understood that other integral liquid-coolant passageways can be formed in other portions of the x-ray tube 100. For example, integral liquid-coolant passageways can be formed in the cathode assembly 102. Therefore, the example x-ray tube liquid coolant circulation system can be extended to cool other portions of the housing of the x-ray tube 100.

5. Alternative Can

With reference now to FIGS. 4A-4D, an alternative can 500 is disclosed. The alternative can 500 is similar in form and function to the example can 200 disclosed in FIGS. 1A-2C. In particular, the alternative can 500 defines a window frame 502 to which an x-ray tube window (not shown) is configured to be attached and through which x-rays produced within the can 500 may exit the can 500. The can 500 also defines an anode shaft opening 504 through which an anode shaft of a rotating anode may be positioned, and a cathode opening through which electrons from a cathode can enter the can 500.

Figure 4A:
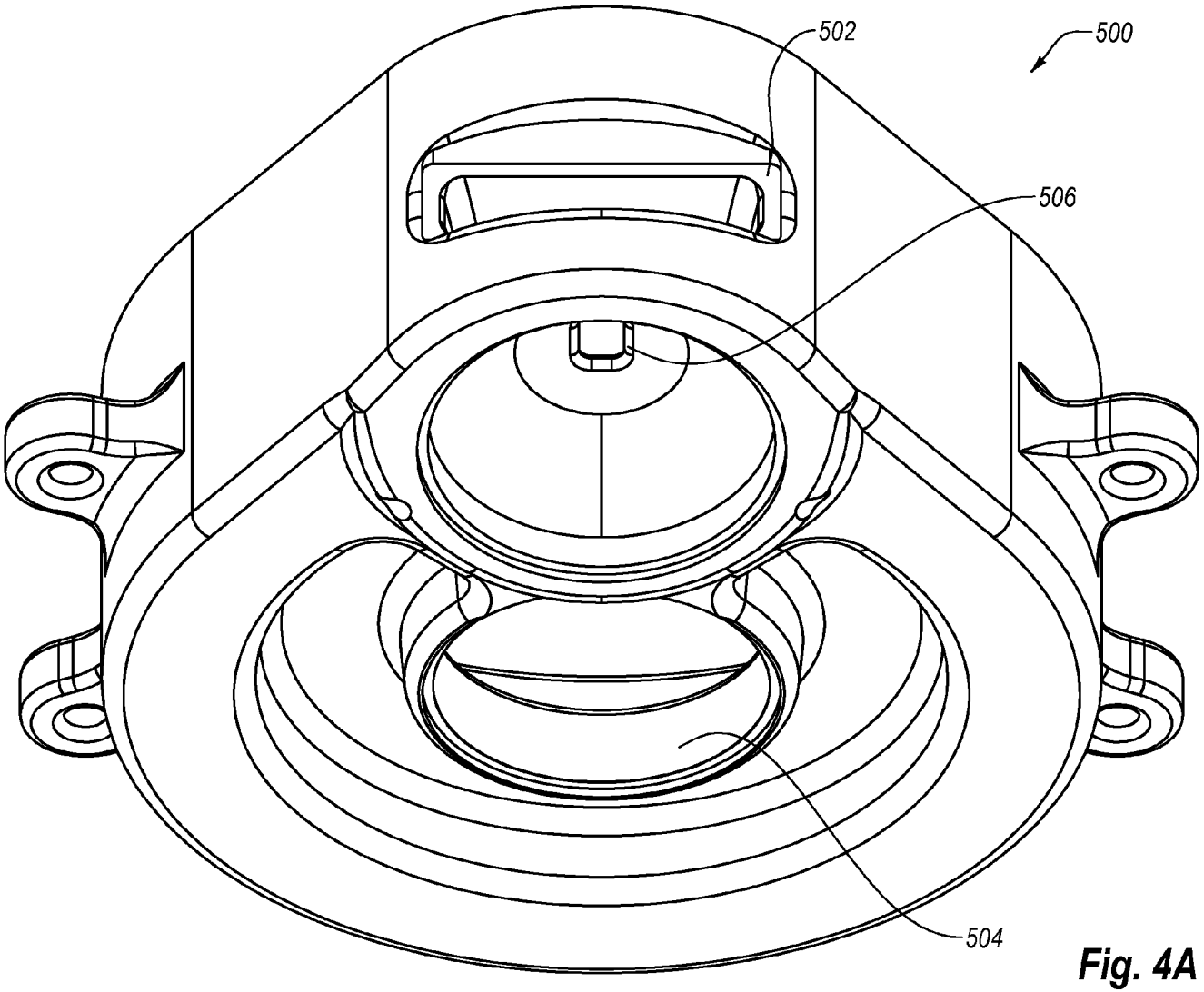
FIG. 4A is a perspective view of an alternative can.
Figure 4B:
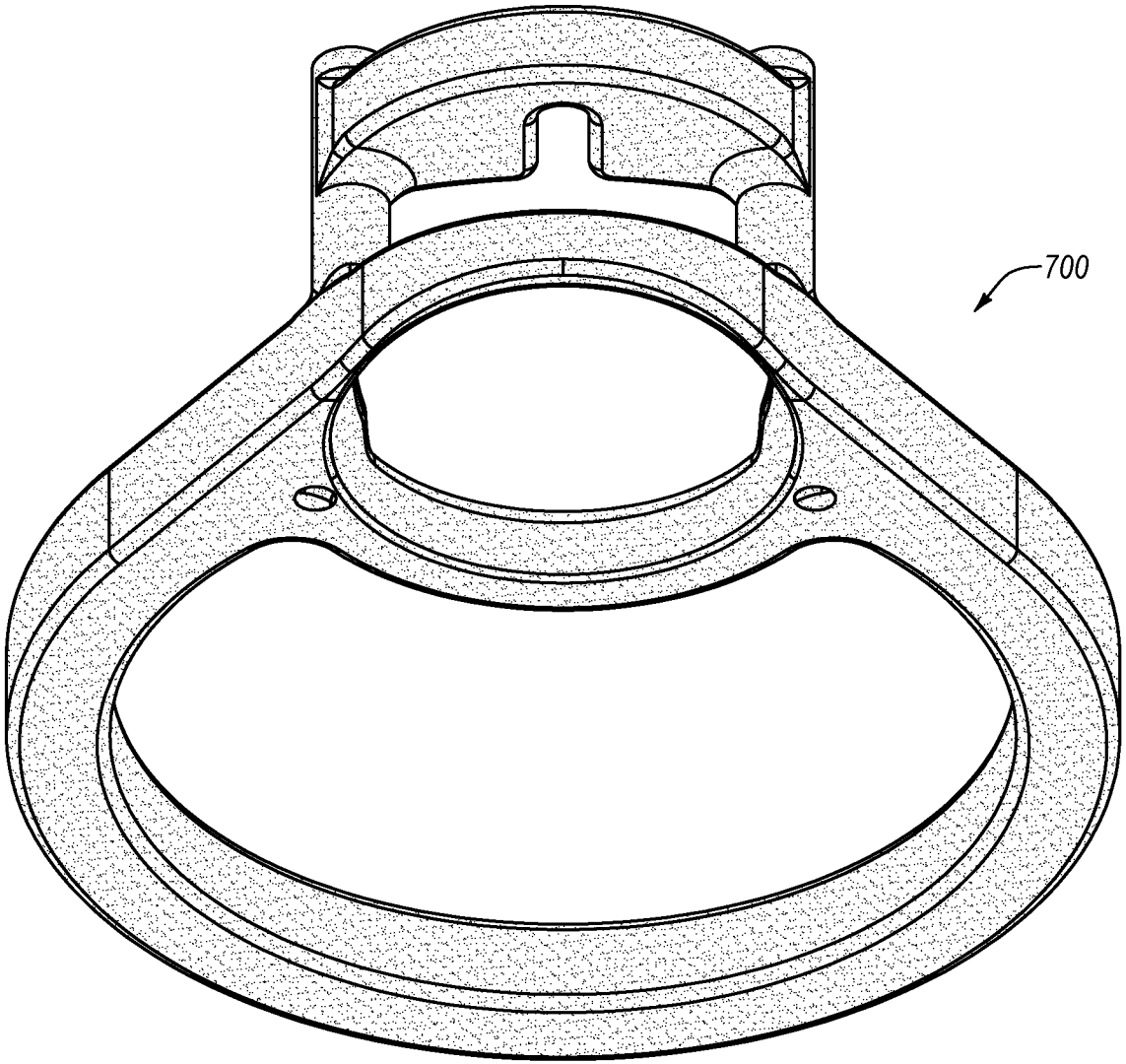
FIG. 4B is a perspective view of a solid outline of integral liquid-coolant passageways of the alternative can of FIG. 4A.
Figure 4C:
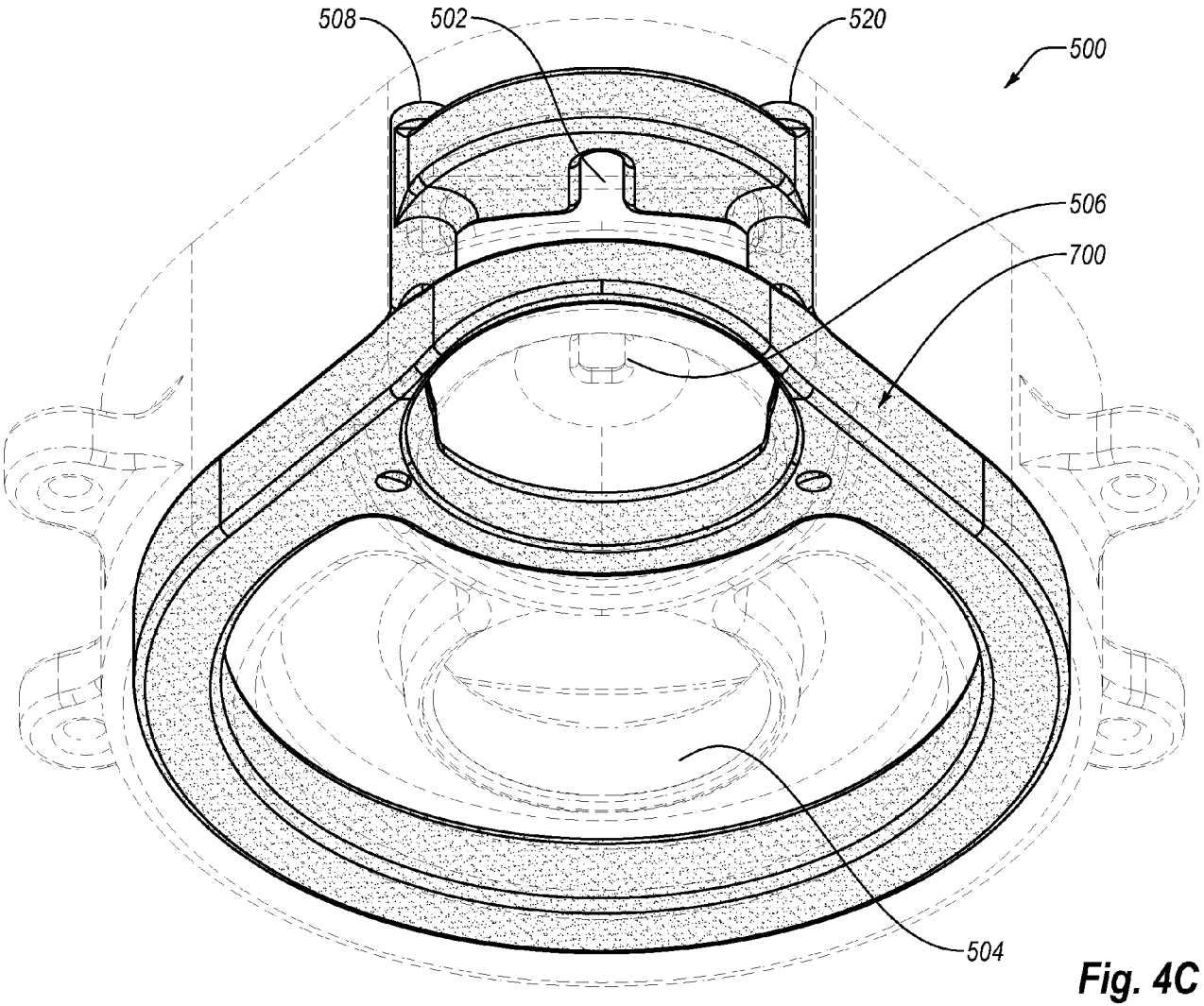
FIG. 4C is a partially transparent view of the can of FIG. 4A cast around the solid outline of the integral liquid-coolant passageways of FIG. 4B.
Figure 4D:
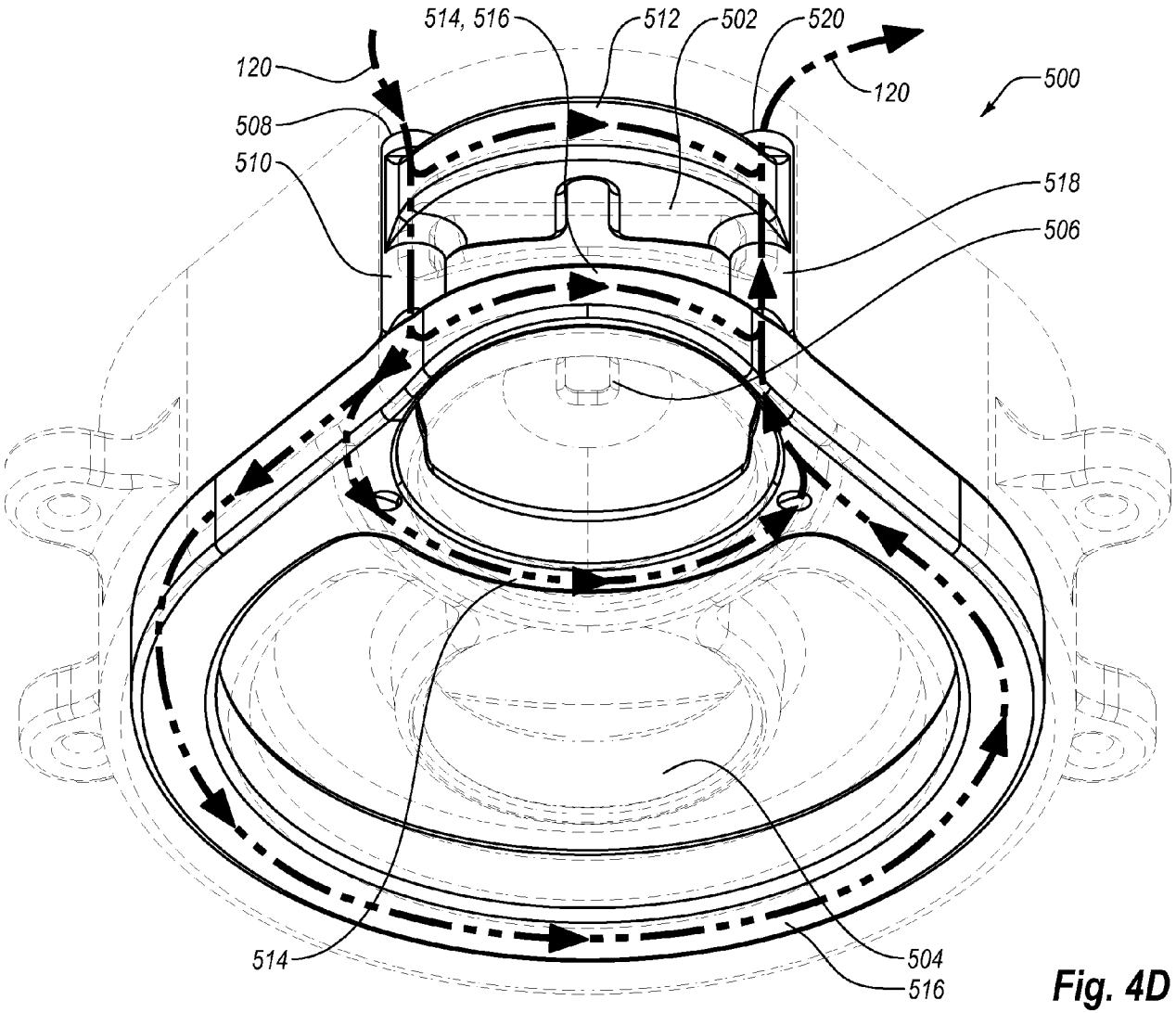
FIG. 4D is a partially transparent view of the can of FIG. 4A after the solid outline of the integral liquid-coolant passageways of FIG. 4B has been removed leaving open integral liquid-coolant passageways.

As disclosed in FIG. 4D, the can 500 also defines ports 508 and 520 and integral liquid-coolant passageways 510-518. The passageway 510 connects the port 508 to the passageway 512 and to the passageways 514 and 516. Similarly, the passageway 518 connects the passageways 514 and 516 to the passageway 512 and the port 520. It is noted that the passageways 510-518 cooperate to substantially surround the window frame 502. It is also noted that the passageway 514 substantially surrounds the cathode opening 506. It is further noted that the passageway 516 substantially surrounds the anode shaft opening 504 and faces the target track of the anode that is placed in the can 500 (not shown).

Also disclosed in FIG. 4D, as the coolant 120 circulates into the can 500 through the port 508, for example, a portion of the coolant 120 can circulate from the passageway 510 through the passageway 512 and another portion of the coolant 120 will circulate from the passageway 510 to the passageways 514 and 516. Similarly, a portion of the coolant 120 will circulate through the passageway 514 while another portion of the coolant 120 will circulate through the passageway 516 before exiting the alternative can 500 through the passageway 518 and the port 520. As the coolant 120 flows through the integral liquid-coolant passageways 510-518, the circulating coolant 120 functions to transfer the heat in the can 500 generated as a byproduct of x-ray tube operation to the circulating coolant 120.

6. Example Integral Liquid-Coolant Passageway Formation

Figure 5:
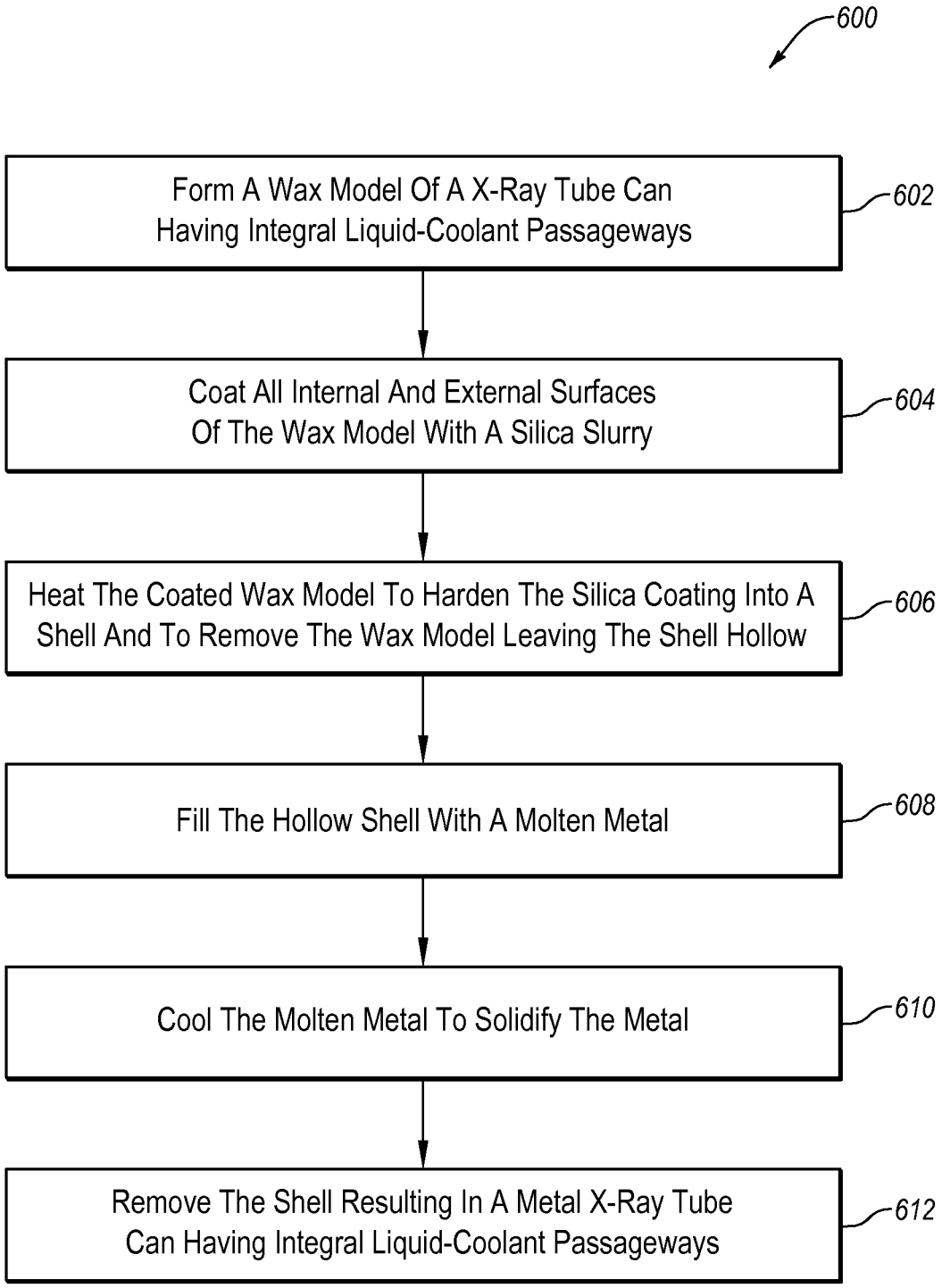
FIG. 5 is a flowchart of an example method for forming the alternative can of FIG. 4A.

With continuing reference to FIGS. 4A-4D, and with reference also to FIG. 5, one example process 600 for forming the alternative can 500 is disclosed. It is understood that prior to the performance of the example process 600, a reusable mold of the can 500 can be manufactured. The mold may include having multiple pieces. The mold enables the production of wax models of the can 500.

First, at act 602, a wax model of an x-ray tube can having integral liquid-coolant passageways is formed. For example, a wax model of the can 500 disclosed in FIG. 4A can be formed. The wax model can include the integral liquid-coolant passageways 510-518 disclosed in FIG. 4D. Next, at act 604, all internal and external surfaces of the wax model are coated with a silica slurry. Then, at act 606, the coated wax model is heated to harden the silica coating into a shell and to remove the wax model leaving the shell hollow. For example, a shell 700 of the eventual liquid-coolant passageways 510-518 (see FIG. 4D) of the can 500 is disclosed in FIG. 4B.

Next, at act 608, the hollow shell is filled with a molten metal. For example, molten metal can be poured into a hollow shell have inside surfaces defined by the dashed lines and the shell 700 disclosed in FIG. 4C. Then, at act 610, the molten metal is cooled to solidify the metal. Finally, at act 612, the shell is removed resulting in a metal x-ray tube can having integral liquid-coolant passageways. For example, the shell can be removed resulting in the metal x-ray tube can 500 disclosed in FIG. 4A having the integral liquid-coolant passageway 510-518 disclosed in FIG. 4D.

The example embodiments disclosed herein may be embodied in other specific forms. The example embodiments disclosed herein are therefore to be considered in all respects only as illustrative and not restrictive.

What is claimed is:

1. An x-ray tube comprising:

a can at least partially defining an evacuated enclosure, the can having first integral liquid-coolant passageways formed therein, the can configured to have a liquid coolant circulated through the first integral liquid-coolant passageways to thereby cool the can without the can being submersed in a liquid coolant;

a cathode at least partially positioned within the evacuated enclosure;

an anode at least partially positioned within the evacuated enclosure; and a stator configured to rotate the anode and at least partially positioned within a stator housing, the stator housing having a second integral liquid-coolant passageway formed therein, the stator housing configured to have a liquid coolant circulated through the second integral liquid-coolant passageway to thereby cool the stator housing without the stator housing being submersed in a liquid coolant.

2. The x-ray tube as recited in claim 1, wherein the second integral liquid-coolant passageway substantially surrounds the stator.

3. The x-ray tube as recited in claim 1, wherein the first integral liquid-coolant passageways and the second integral liquid-coolant passageways are coupled to each other via one or more hoses.

4. The x-ray tube as recited in claim 1, wherein the x-ray tube further comprises a window and the can defines a window frame to which the window is attached and through which x-rays produced at the anode may exit the can, the window partially defining the evacuated enclosure, the first integral liquid-coolant passageways surrounding the window frame to thereby cool the window without the window being submersed in a liquid coolant.

5. The x-ray tube as recited in claim 1, wherein at least one of the first integral liquid-coolant passageways substantially surrounds the cathode.

6. The x-ray tube as recited in claim 1, wherein at least one of the first integral liquid-coolant passageways is positioned behind the anode.

7. The x-ray tube as recited in claim 1, wherein the can is formed from stainless steel.

8. An x-ray system comprising:

the x-ray tube as recited in claim 1;

liquid coolant; and a heat exchanger configured to circulate the liquid coolant between the first integral liquid-coolant passageways and the heat exchanger.

9. The x-ray tube as recited in claim 1, wherein the x-ray tube is devoid of a liquid-coolant reservoir containing the can submersed in liquid coolant within the liquid-coolant reservoir.

10. The x-ray tube as recited in claim 1, wherein the x-ray tube is devoid of a liquid-coolant reservoir containing the stator housing submersed in liquid coolant within the liquid-coolant reservoir.

11. An x-ray system comprising:

a liquid coolant;

a heat exchanger; and an x-ray tube comprising:

a cathode at least partially positioned within an evacuated enclosure;

a rotating anode at least partially positioned within the evacuated enclosure;

a stator configured to rotate the anode;

a stator housing within which the stator is at least partially positioned, the stator housing having a first integral liquid-coolant passageway formed therein, the heat exchanger configured to circulate the liquid coolant through the first integral liquid-coolant passageway to thereby cool the stator housing without the stator housing being submersed in a liquid coolant; and a can at least partially defining the evacuated enclosure, the can having second integral liquid-coolant passageways formed therein, the heat exchanger configured to circulate the liquid coolant through the second integral liquid-coolant passageways to thereby cool the can without the can being submersed in a liquid coolant.

12. The x-ray system as recited in claim 11, wherein the first integral liquid-coolant passageway substantially surrounds the stator.

13. The x-ray system as recited in claim 11, wherein the first integral liquid-coolant passageway and the second integral liquid-coolant passageways are coupled to each other via one or more hoses.

14. The x-ray system as recited in claim 11, wherein the x-ray tube further comprises a window and the can defines a window frame to which the window is attached and through which x-rays produced at the anode may exit the can, the window partially defining the evacuated enclosure, at least one of the second integral liquid-coolant passageways surrounds the window frame to thereby cool the window without the window being submersed in a liquid coolant.

15. The x-ray system as recited in claim 11, wherein at least one of the second integral liquid-coolant passageways substantially surrounds the cathode.

16. The x-ray system as recited in claim 11, wherein at least one of the second integral liquid-coolant passageways is positioned behind the anode.

17. The x-ray system as recited in claim 11, wherein the stator housing is formed from copper.

18. The x-ray system as recited in claim 11, wherein the x-ray tube is devoid of a liquid-coolant reservoir containing the can and stator submersed in liquid coolant within the liquid-coolant reservoir.

* * * * *